United States Patent [19]

Wandeloski

[11] 4,310,959

[45] Jan. 19, 1982

[54] METHOD OF UPHOLSTERING A COUCH AND EDGE WIRE SPRING STABILIZING CLAMP

[76] Inventor: James C. Wandeloski, 2900 Pontiac Trail, Walled Lake, Mich. 48088

[21] Appl. No.: 131,070

[22] Filed: Mar. 17, 1980

[51] Int. Cl.[3] ..... B68G 7/00; B68G 15/00; A47B 96/06

[52] U.S. Cl. ..... 29/91.1; 29/91.7; 248/229

[58] Field of Search ..... 29/91, 91.1, 91.2, 91.3, 29/91.4, 91.5, 91.6, 91.7, 91.8; 248/228, 229, 210, 218.4, 316 B, 295.1, 226.4, 314; 24/81 PA, 73 LA; 269/90

[56] References Cited

U.S. PATENT DOCUMENTS

| | | | |
|---|---|---|---|
| 62,340 | 2/1867 | Johns | 29/91 |
| 673,718 | 5/1901 | Marquardt et al. | 29/91.7 |
| 1,631,355 | 6/1927 | Baldwin | 248/316 B |
| 2,464,642 | 3/1949 | Hellings | 269/90 |
| 2,914,829 | 12/1959 | Willemain | 248/229 |
| 3,317,171 | 5/1967 | Kramer | 248/229 |
| 3,484,066 | 12/1969 | Aunspaugh | 248/229 |
| 3,565,380 | 2/1971 | Langren | 248/229 |

FOREIGN PATENT DOCUMENTS

| | | | |
|---|---|---|---|
| 467915 | 3/1927 | Fed. Rep. of Germany | 29/91 |

*Primary Examiner*—Harrison L. Hinson
*Attorney, Agent, or Firm*—Cullen, Sloman, Cantor, Grauer, Scott & Rutherford

[57] ABSTRACT

In the method of upholstering a couch or a chair having a hollow frame with a front rail, a series of rows of coiled springs mounted upon and projected above the frame and parallel to the rail, and an edge wire extending tangent and connected to the top coils of the row of springs adjacent the rail, including the step of tying the springs of the other rows together, and to the row of springs adjacent the rail and to the frame; the improvement which comprises the preliminary step before tying the springs of selectively mounting, spacing and securing a plurality of upright edge wire clamps to and along the rail outwardly thereof. Each clamp includes an upright support having an adjustable edge wire retaining block thereon with a depending edge wire retainer. Further steps include selectively adjusting the edge wire retaining blocks on each clamp to a predetermined height with the corresponding edge wire retaininers longitudinally aligned and retainingly engaging the edge wire. And securing the respective blocks to the corresponding support for locating and stabilizing the row of springs adjacent the rail for maintaining the outer edge of the top coils of the row of springs adjacent the rail in a straight line and at a uniform height in order to facilitate the individual tying of the springs of the other rows of the springs together, and to the first row of springs and to the frame. And the edge wire clamp itself which further includes a manually operable grip for adjustably securing the support to the rail. A further grip adjustably secures the block to the support at a predetermined height.

2 Claims, 7 Drawing Figures

METHOD OF UPHOLSTERING A COUCH AND EDGE WIRE SPRING STABILIZING CLAMP

BACKGROUND OF THE INVENTION

In connection with the tying or retying by suitable cords, the springs of a series of longitudinally extending rows of spaced coil springs within the frame of a couch or a chair, there has existed the problem of sufficiently stabilizing the row of springs adjacent the front rail of the frame for maintaining them at a uniform height and with their outer edges along a straight line, which is arranged above and outwardly of the frame rail, thereby facilitate the subsequent step of tying the springs of the other rows of springs to each other and tying the springs of the other rows to the springs within the first row adjacent the front rail and further anchoring the springs with respect to adjacent portions of the frame.

Considerable difficulty has been experienced in maintaining a straight edge for the outermost row of springs adajcent to the front rail of the frame and holding them at a uniform height so as to render more easily done the effective tying of the springs to each other and to the frame. Various efforts have been made to provide some means of sufficiently stabilizing the springs as would assist in some manner in the subsequent tying of the springs to each other and to the adjacent portions of the frame. Heretofore, a certain amount of retying of the springs was necessary after the initial tying thereof due to the inability in the first instance of providing a stabilizing system for at least the front row of the springs adjacent the front rail of the furniture framework. Some examples of earlier patent efforts employed to stabilize the springs prior to an upholstering operation are shown in the following patents:

| | | |
|---|---|---|
| E. F. Johns | 62,340 | February 26, 1867 |
| E. G. Marquardt | 673,718 | May 7, 1901 |

Earlier clamps per se of more general utility are disclosed in one or more of the following patents:

| | |
|---|---|
| 2,464,672 | March 15, 1949 |
| 2,464,642 | March 15, 1949 |
| 2,367,256 | January 16, 1945 |
| 1,631,355 | June 7, 1927 |
| 3,565,380 | February 23, 1971 |
| 2,898,069 | August 4, 1959 |
| Des. 253,089 | October 9, 1979 |
| 1,132,362 | March 16, 1915 |

SUMMARY OF THE INVENTION

An important feature of the present invention is to provide an edge wire clamp which is adapted for mounting upon and along the front rail of a hollow frame of a couch or chair to be upholstered and wherein the frame has a conventional webbing thereon and a series of longitudinaly extending rows of spaced coiled springs within the frame, mounted upon the webbing, parallel to the rail and projecting above the frame. A longitudinal edge wire extends tangent to and is connected to the top coils of the row of springs adjacent the rail for securing said row of springs together. The present edge wire clamp comprises an upright first support which bears against the exterior of the front rail together with a manually adjustable gripping means upon the first support adapted to operatively engage said rail, which may be of varying thicknesses, for adjustably securing the first support thereto. An edge wire retainer block is slidably mounted upon the first support for selective adjustments thereon and includes a gripping means adapted to operatively engage the first support for securing the block at a predetermined height. An edge wire retaining means is joined to and depends from the retainer block and is spaced outwardly of the first support and rail and is adapted to secure the edge wire relative to the first support. The edge wire clamps are adapted to facilitate locating and stabilizing the row of springs adjacent said front rail and for maintaining the outer edges of the top coils of the row of springs in a straight line and at a uniform height outwardly of the rail to facilitate the subsequent individual tying of the springs of the other rows of springs together, to the first row of springs adjacent the rail and to the frame.

A primary feature of the present invention is utilization of a plurality of selectively spaced edge wire clamps which are adapted for mounting upon and along the front rail of the hollow frame of a couch or chair, and wherein the edge wire clamp includes a vertically adjustable block with depending edge wire engaging and retaining means for the primary purpose of locating and stabilizing the row of springs adjacent the rail and for maintaining the outer edges of the top coils of the row of springs adjacent the rail in a straight line and at a uniform height outwardly of the rail, and this to facilitate the subsequent individual tying of the springs of the other rows of springs together, to the row of springs adjacent said rail and to the frame.

A further feature of the present edge wire clamp includes retaining means upon the first support to limit adjustments in opposite directions of the edge wire retainer block upon said first support.

A further feature of the present invention resides in the method of upholstering a couch or chair which has such hollow frame and front rail, the usual webbing and the rows of coil springs with a longitudinal edge wire which extends tangent to the top coils of the row of springs adjacent the rail and connected thereto, including the tying of the springs of the other rows together and to the first row of springs adjacent the rail and to the frame. Said feature includes the preliminary step before said tying, of selectively mounting, spacing and securing a plurality of upright edge wire clamps to and along the front rail outwardly thereof. Each clamp includes an upright support having an edge wire retaining block movably mounted thereon and edge wire retaining means depending therefrom. A further step includes selectively adjusting the edge wire retaining block on each clamp to a predetermined height with the corresponding edge wire retaining means of the respective clamps longitudinally aligned and retainingly engaging the edge wire. A final step includes the securing of the respective blocks to the corresponding support for locating and stabilizing the row of springs adjacent said front rail for maintaining the outer edges of the top coils of the said row of springs in a straight line and at a uniform height in order to facilitate the subsequent individual tying of the springs of the other rows of the springs together, to the first row of springs and to the frame.

These and other features will be seen from the following specification and claims in conjunction with the appended drawings.

THE DRAWINGS

It will be understood that the above drawings are illustrative of the steps of the present method and of one form of edge wire clamp utilized, and that other steps and clamps may be employed within the scope of the claims hereafter set forth.

DETAILED DESCRIPTION OF AN EMBODIMENT OF THE INVENTION INCLUDING THE METHOD AND THE EDGE WIRE CLAMP THEREFORE

Figure 1:
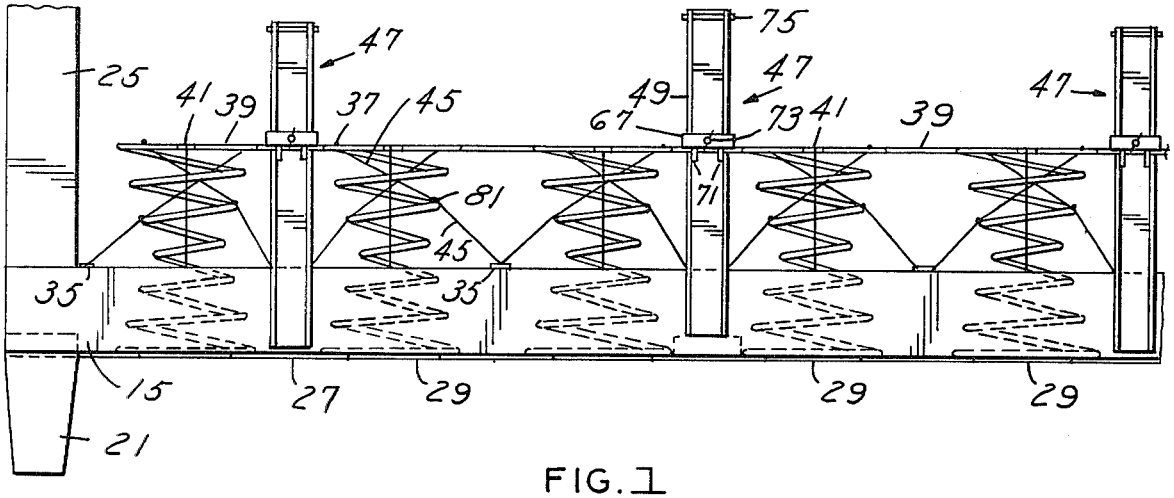
FIG. 1 is a fragmentary front elevational view of an unupholstered couch showing the front row of coiled springs with connected edge wire and a series of edge wire clamps secured upon the frame.
Figure 2:
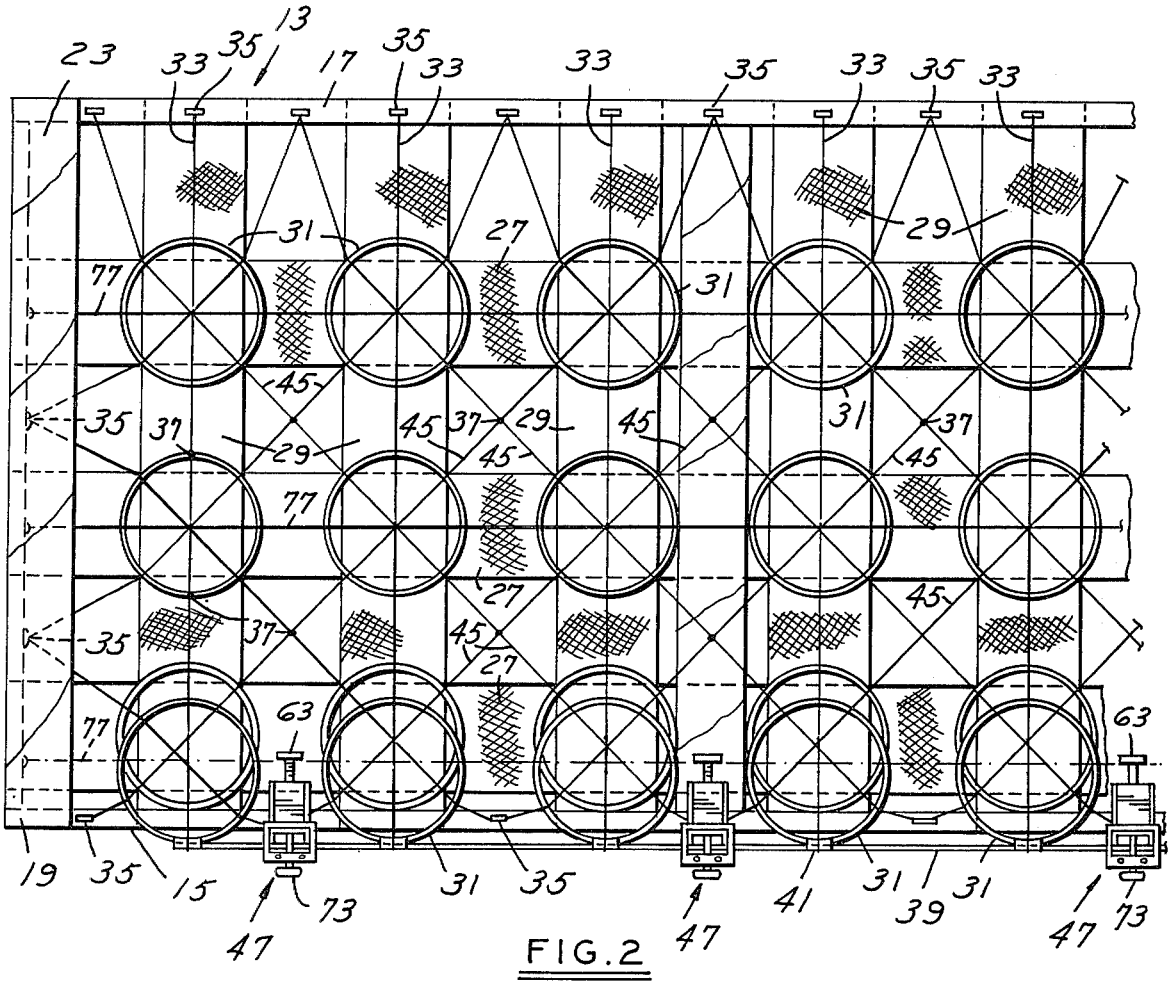
FIG. 2 is a fragmentary plan view of the framework and arrangement of coil springs in rows upon the webbing of the couch showing the arrangement, location and securing the respective edge wire clamps upon the front rail of the frame.
Figure 3:
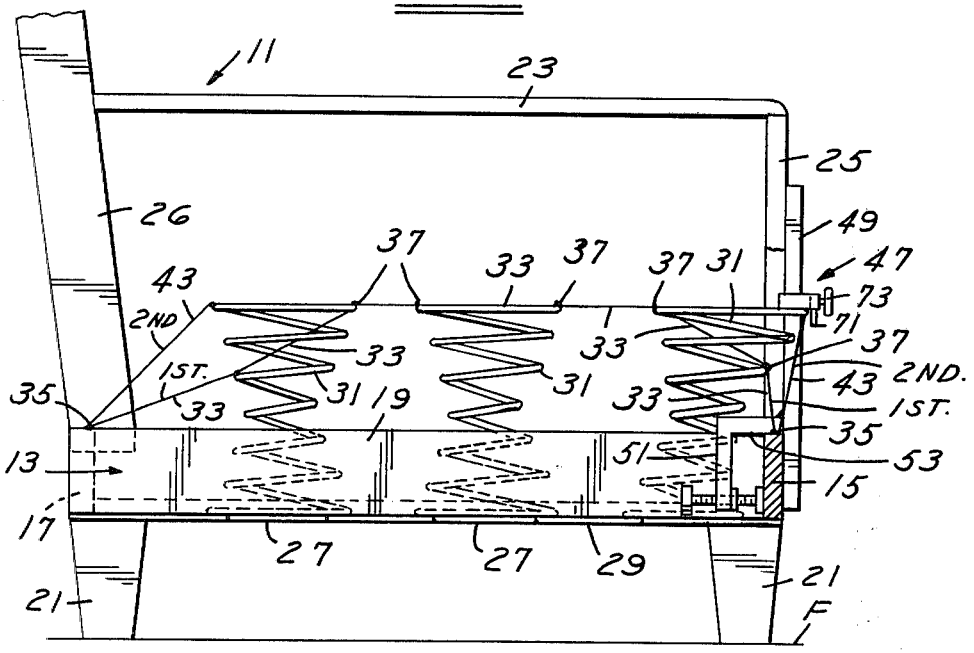
FIG. 3 is a fragmentary side elevational view of the couch of FIGS. 1 and 2.
Figure 7:
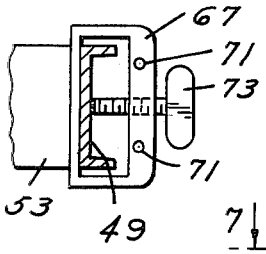
FIG. 7 is a fragmentary plan section taken in the direction of arrows 7—7 of FIG. 4.

Referring to the drawings, and particularly FIGS. 1, 2 and 3, the couch or chair is fragmentarily shown at 11 upon the floor F which is to be upholstered or reupholstered. In the description hereunder, making reference to a couch having a frame, it is contemplated as equivalent that the same description would apply to a chair similarly having a frame and spring construction as hereafter set forth.

The couch has a hollow, rectangular frame 13, FIGS. 2 and 3, which includes upright front rail 15, upright back rail 17 and conventional side rails 19 mounted upon the conventional legs 21. The couch includes at its opposide ends a conventional arm 23, depending arm support 25, which extends to and is suitably secured to the frame, as well as a conventional back frame 26 above and adjacent back rail 17.

As is conventional, there is applied upon the bottom of the hollow frame a series of longitudinal webbing strips 27, which at their ends are secured to the respective side rails 19, and a series of interwoven transverse webs 29, which at their opposite ends are secured respectively to the front and back rails.

A series of longitudinally extending rows of spaced coil springs 31 are positioned within the frame and respectively mounted at their lower ends upon the webbing, normally at the intersections thereof. Said rows are arranged parallel to the front rail with the springs projecting above the frame, as shown in FIGS. 1 and 3. The series of rows of coil springs 31 extend from the front row, which is arranged in a line and adjacent the front rail, hereafter referred to as the front row of springs in some instances. Additional rows of coil springs in rows upon said webbing extend to and are spaced from the back rail 17.

CONVENTIONAL STEP

FIGS. 2 and 3 show the series of parallel front to back tie cords 33 which extends tranversely between each of the rows of springs and are normally anchored to the frame by conventional clips 35. The tie cords referred to do not form a part of the present invention but illustrate the means by which respective rows of coil springs are tied to each other and to the frame as a step of a conventional character. The tie cords 33 are tied as at 37, FIG. 3, to the respective adjacent coil springs in the rearwardly extending rows of coil springs. The rearwardly extending tie cords 33 are joined to each coil spring by two individual ties 37, FIGS. 2 and 3.

As shown in FIG. 3, each of the tie cords 33 anchored at 35 at the front rail 15 is connected by a tie 37 to the adjacent coil of the spring below the top coil, usually the third coil down, then extends upwardly to the top coil and is tied thereto at 37. The cord 33 extends rearwardly to the next adjacent coil spring 33 and is tied thereto upon opposite sides of the top coil and extends to the next coil and is tied on one side at 37. Cord 33 extends angularly downwardly and is tied to approximately the third coil of the outer springs adjacent the back rail 17 as by the tie 83 and then extends to the back rail 17 and is clipped or otherwise secured thereto as at 35. This is only mentioned to describe part of the tying which occurs after the set of coil springs adjacent the front rail had been first stabilized by the use of the present edge wire clamp of FIGS. 4–7, hereafter described.

As is also conventional, before the upholstering and before the tying of the respective springs together, an elongated edge wire 39 extends tangent to the outer front edges of the respective coils of the first row of coil springs, as shown in FIGS. 1 and 2, and is suitably secured thereto by a series of longitudinally spaced clips 41. The tying step includes the additional tie cord 43, FIG. 3, which connects the top coil of the rearmost coiled spring to the back rail by a suitable clip 35. There is also shown in FIG. 3 a second tie cord 43 which extends from and is anchored by a suitable clip to the front rail 15 at its upper end and is connected as at 37 to the outer edge of the top coil of each of the springs in the front row adjacent the front rail 15 of the framework.

There are preliminarily secured to the framework a series of diagonal tie cords 45 anchored to the respective front, side and rear rails with suitable clips. There are individually tied diagonally to opposite sides of the individual coils from different rows of springs from front to back. The series of diagonal tie cords are parallel to each other and are respectively anchored at their ends to parts of the hollow frame. In the tying operation, the respective cords are tied to and interconnect the coil springs in the respective rows to each other. This includes the tying cords 33, the diagonal tie cords 45, as well as an additional series of longitudinally extending tie cords 77, which are parallel to each other and which are anchored respectively to the side rails 19 at opposite ends of the framework. These longitudinal ties are generally indicated at 77, FIG. 1. The longitudinal tie 77, which is adjacent the front rail 15 is shown in dash lines merely to indicate that this tie is not affixed to the respective coils of the front row of springs adjacent the front rail until after the respective edge wire clamps have served their function and have been removed from the framework.

The present invention is directed to certain method steps which are employed with respect to a couch or a chair frame and the rows of coiled springs therein. The primary purpose is to stabilize the front row of coiled springs for maintaining the top coils of the respective front row of springs in longitudinal alignment and at a predetermined uniform height. This includes holding edge wire 39 between the top coils of the front row so as to extend slightly outward of the front rail 15, FIG. 3. This occurs before the subsequent tying operation, above described.

There is utilized in conjunction with the present method certain steps prior to the tying of the respective coils of springs in rows to each other and to the front row of coiled springs and to the repsective frame elements. The clamps function to locate and stabilize the front row of springs adjacent the rail maintaining the outer edges of the top coils of the row of springs in a straight line and at a uniform height outwardly of the rail. This facilitates the subsequent individual tying of the springs of the other rows of springs together to each other to the row of springs adjacent the rail and to the frame.

The present edge wire clamp 47, shown in FIGS. 1, 2 and 3, as applied to the front rail 15 of the frame 13 of the couch or chair, is shown in further detail and on an enlarged scale in FIGS. 4–7.

Referring to FIGS. 4–7, the edge wire clamp is generally in the shape of a lower case "h" and includes an upright first support 49 of channel form. Upright grip support 51, also of channel form, is secured to and depends from the outer end of the holder channl 53 whose inner end is suitably secured to the first support 49 be welds 55. These welds are also illustrative of the means for securing grip support channel 51 to the holder channel 53, FIGS. 4 and 5.

Grip 57, in the form of a disc for illustration, is journaled upon screw 59 as shown at 61. Said screw is threaded through the nut 65 upon the interior of grip support 51 and at its outer end terminates in the handle 63, of hex-shape in the illustrative embodiment.

Edge wire retainer block 67 has a rectangular opening therein and is slidably mounted upon the upright first support 49. The back bar 69 of said block has a threaded aperture and receives the friction hand screw 73, which projects therethrough. Said screws are adapted for operative retaining engagement with a portion of the first support 49 for securing the edge wire retainer block in the desired vertical position at a height corresponding to the predetermined height for the edge wire 39.

Figure 4:
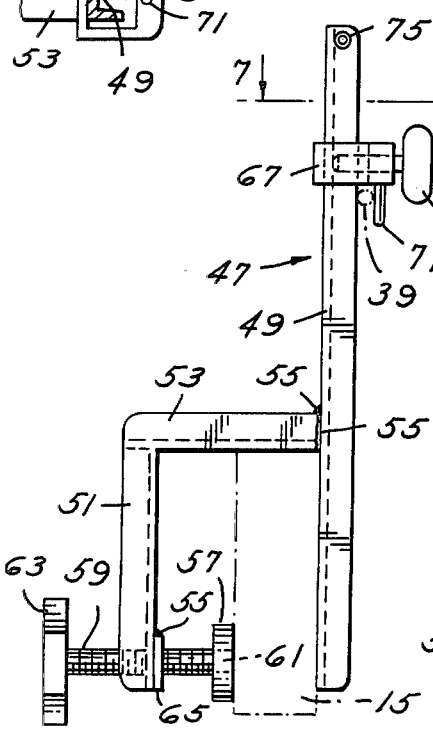
FIG. 4 is a side elevational view on an enlarged scale of the edge wire clamp shown in FIG. 3.

A pair of edge wire retaining pins 71, sometimes referred hereafter as edge wire retaining means, are secured to and depend from back bar 69 of the edge wire retainer block and are spaced outwardly of first support 49 and are adapted to retainingly engage and secure the edge wire 39, as shown in FIG. 4.

Figure 5:
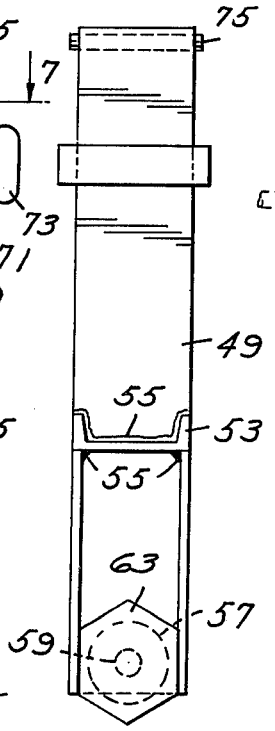
FIG. 5 is a left side elevational view thereof.
Figure 6:
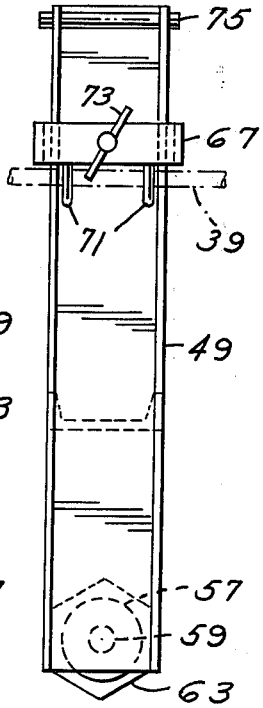
FIG. 6 is a right side elevational view thereof.

The transverse stop bar 75 extends across upper end portions of the first support 49 and projects outwardly thereof, FIGS. 5 and 6, and is secured thereto in oder to limit relative upward movements of the edge wire retainer block 67. Relative downwardly movement of said block is limited by the channel holder plate 53, which projects from the first support 49, as in FIG. 4.

In use, and before the upholstering over of the couch or chair, the coil springs are exposed, as mounted upon the webbing in a series of parallel rows, which are parallel to the front rail 15, and for tying are arranged at random and sag due to the resiliency of the respectively coils. Accordingly, edge wire 39 is employed so as to extend tangentially across the outer edges of the first row of coil springs, namely, the row of coil springs directly adjacent the front rail 15 and is secured to the respective top coils of each of said springs as by the fasteners or clips 41.

Thus, the edge wire 39 at least secures the top coils of each of the springs of the first row of springs together in the manner shown in FIGS. 1 and 2. As a preliminary step not part of the present process, the respective tie cords 33 being the rearwardly extending cords, the diagonal tie cords 45 and the longitudinal tie cords 77 are at least at their one ends suitably anchored to some portion of the hollow framework, such as by clips 35. Thus, all the tie cords are in place ready for the tying operation.

The present edge wire clamp of which a series are employed are then adjustably positioned upon the front rail 15 of the frame, normally spaced between the respective springs, as in FIG. 2. These clamps overlie the anchorings of some of the diagonal tie cords 45. Since the front rail 15 may vary in thickness, the present hand grip 59, 63 is adjusted so that its grip 57 is in operative retaining registry with a portion of the front rail. At the same time the holder channel 53 extending from the first support 49 supportably bears upon said front rail, as in FIG. 4.

Once the respective edge wire clamps have been secured to the front rail in spaced relation, as shown in FIG. 2, with the respective edge wire retaining blocks positioned outwardly of said rail, as in FIG. 3, there is followed the step of selectively adjusting the edge wire retaining blocks 67 respectively and successively to a predetermined height and with the corresponding edge wire retaining pins 71 longitudinally aligned and retaingly engaging the edge wire 39, as in FIGS. 1, 2, 3, and 4 relative to first support 49.

A further step includes the securing of the respective block 67 for the corresponding support 49 employing the friction hand screw 73.

The respective edge wire retaining pins 71 extend around the outer portion of the edge wire 39 so as to grip said edge wire between the first support 49 and the corresponding edge wire retaining pins 71, as in FIG. 4. This is for the purpose of locating and stabilizing the first row of springs adjacent the rail and for maintaining the outer edges of the top coils of the row of springs in a straight line and at a uniform height. This is all done in order to facilitate the subsequent individual tying of the springs of the other rows of the springs together to each other and the further tying of said other rows of springs to the first row of springs and to the frame, which is a normal and conventional step.

Since the first fow of coiled springs adjacent the front rail are already stabilized by the use of the series of the present edge wire clamps, it becomes a much easier process to individually tie the respective top coils of the other springs to each other and to the front row coils to the framework. In a conventional manner, the previously anchored diagonal tie cords 45 adjacent the front rail extend angularly upward and first engage and are tied to approximately the third coil of the adjacent coil spring in the first row of coil springs next to the front rail 15, as best shown in FIG. 1. The diagonal tie cord 45 extends angularly upwardly, as shown in FIG. 1, and is tied as at 37 to the opposite side of the top coil of the adjacent springs. This process continues in a conventional manner until the free ends of the diagonal cords are anchored to the respective back frame or side frames.

The tying step, though not part of the present invention, also includes the application of the series of parallel longitudinally extending tie cords 77. These tie cords anchored to the end rails 19 are individually tied to opposite sides of the top coils of the individual coil springs starting from the back rail or the two rows shown, but excluding the first row of coil springs adjacent the front rail. Once this has been completed, all of the clamps 47 are removed and thereafter the last longitudinal tie cord 77, shown in dash lines in FIG. 2, extends over and connects opposite sides of the top coils of the individual coil springs of the first row of coil springs.

By the present method, and employing the present edge wire clamp, the edge wire 39 is held approximately one-half inch in front of the front rail while the springs are being tied.

One advantage of the present method and the use of the present edge wire clamp is that it provides a straight spring edge that is in perfect relationship to the front rail, and wherein the top coils of the respective springs, particularly the front row, are in alignment and are at a uniform height and stabilized before tying in a conventional manner. This eliminates the retying of some of the coil springs after the other sets of springs have been tied to each other.

With the first row of spring adjacent the front rail properly stabilized, the subsequent tying of all of the springs together and to each other and to the framework provides proper spring support for the subsequent upholstering with everything straight and tight and in proper alignment.

Thus, the respective clamps remain in place throughout the subsequent full tying of all the springs with the exception of the application of the last longitudinal tie cord 77, which is shown in dash lines in FIG. 2. This last tie cord is added after the clamps have been removed.

The tying of the respective springs, involving the respective tie cords 33, 45 and 77 provides at least eight connections of all of the respective tie cords to the respective cords of the adjacent springs in the adjacent and parallel rows in a manner best illustrated in FIG. 2.

With respect to the diagonal tie cords 45, said cord adjacent the front rail first engages the outermost approximate third coil down from the top of the adjacent spring and is tied as at 81 with the cord extending upwardly to the opposite side for tying as at 37, as in FIG. 1.

Having described my invention, reference should now be had to the following claims.

I claim:

1. In the method of upholstering a couch or chair having a hollow frame with a front rail, a webbing spanning said frame, a series of longitudinally extending rows of spaced coil springs mounted upon the webbing parallel to said rail and projecting above said frame, and a longitudinal edge wire extending tangent to the top coils of the row of springs adjacent said rail and connected thereto, including the tying of the springs of the other rows together, and to said row of springs adjacent said rail and to said frame;

the preliminary step before said tying of selectively mounting, spacing and securing a plurality of upright edge wire clamps to and along said rail outwardly thereof;

each clamp including an upright support having an edge wire retaining block movably mounted thereon with edge wire retaining means depending therefrom;

selectively adjusting the edge wire retaining blocks on each clamp to a predetermined height with the corresponding edge wire retaining means longitudinally aligned and retaingly engaging said edge wire;

and securing the respective blocks to the corresponding support for locating and stabilizing the row of springs adjacent said rail for maintaining the outer edge of the top coils of said row of springs in a straight line and at a uniform height in order to facilitate the individual tying of the springs of the other rows of the springs together, to said first row of springs and to said frame.

2. An edge wire clamp adapted for mounting upon and along the front rail of a hollow frame of a couch or chair to be upholstered, with the frame having a webbing thereon, a series of longitudinally extending rows of spaced coil springs within the frame mounted upon the webbing parallel to the rail and projecting above the frame, and with the frame also including a longitudinal edge wire extending tangent to the top coils of the row of springs adjacent the rail and connected thereto thereby securing the row of springs together;

said edge wire clamp comprising an upright first support of channel shape configuration, said first support having a vertically extending web provided with inner and outer flat surfaces and a pair of perpendicular side flanges extending away from said surfaces, said outer surfaces adapted to bear against the exterior of the rail;

a manually adjustable gripping member on said first support adapted to operatively engage the rail for adjustably securing said first support thereto;

a grip support of channel shape configuration mounted on said first support and secured thereto;

said manually adjustable gripping means including a manually rotatable screw threaded through said grip support and having a leading end movable toward and away from said outer surface on said first support;

a grip mounted upon the leading end of said rotatable screw adapted to engage the rail;

an edge wire retainer block having a rectangular opening therein through which said first support extends, said opening having a surface engageable with the outer surface of said first support, said block being slidably mounted upon said first support for selective adjustment thereon;

a gripping means on said retainer block including a friction hand operated screw threaded through said block and extending into said opening and engaging the inner surface of said first support, said hand operated screw being adapted to thereby operatively secure said block at a predetermined height on said first support;

an edge wire retaining means including a pair of laterally spaced pins joined to and depending from said retainer block, said pins being spaced laterally from the inner surface of said first support and adatped to secure the edge wire relative to said first support;

and a stop bar extending through said side flanges at the upper end of said channel shape first support and projecting from opposite sides thereof, said stop bar limiting upward adjustments of said retainer block upon said first support;

said edge wire clamp adapted to facilitate locating and stabilizing the row of springs adjacent the rail and for maintaining the outer edges of the top coils of the row of springs in a straight line at a uniform height outwardly of the rail, to facilitate the individual tying of the springs of the other row of springs together, to the row of springs adjacent the rail and to the frame.

* * * * *